US006601971B1

(12) United States Patent
Ko

(10) Patent No.: US 6,601,971 B1
(45) Date of Patent: Aug. 5, 2003

(54) ELONGATED ROPE LIGHT WITH MULTIPLE COLOR SECTIONS

(76) Inventor: Yu-Chow Ko, Unit B, 19/F, Skylodge 1 Dynasty Heights, 8 Yin Ping Road, Kowloon, H.K., P.R. (CN)

( * ) Notice: Subject to any disclaimer, the term of this patent is extended or adjusted under 35 U.S.C. 154(b) by 0 days.

(21) Appl. No.: 10/079,364

(22) Filed: Feb. 21, 2002

(51) Int. Cl.[7] ..... F21S 4/00

(52) U.S. Cl. ..... 362/219; 362/224; 362/236; 362/250; 362/419

(58) Field of Search ..... 362/219, 220, 362/223, 224, 222, 225, 240, 250, 252, 256, 255, 418, 249, 236, 238, 419

(56) References Cited

U.S. PATENT DOCUMENTS

| | | | | | |
|---|---|---|---|---|---|
| 4,607,317 | A | * | 8/1986 | Lin | 362/249 |
| 5,057,981 | A | * | 10/1991 | Bowen et al. | 362/219 |
| 6,217,194 | B1 | * | 4/2001 | Huang | 362/249 |
| 6,283,612 | B1 | * | 9/2001 | Hunter | 362/240 |
| 6,394,623 | B1 | * | 5/2002 | Tsui | 362/249 |
| 6,406,166 | B1 | * | 6/2002 | Ko | 362/249 |
| 6,502,955 | B2 | * | 1/2003 | Ko | 362/219 |
| 6,511,206 | B1 | * | 1/2003 | Fan Wong | 362/250 |
| 6,527,412 | B2 | * | 3/2003 | Ko | 362/249 |

FOREIGN PATENT DOCUMENTS

| | | | | |
|---|---|---|---|---|
| EP | 1178260 A1 | * | 2/2002 | F21S/4/00 |
| GB | 2375597 A | * | 11/2002 | F21S/4/00 |

* cited by examiner

*Primary Examiner*—Sandra O'Shea
*Assistant Examiner*—John Anthony Ward
(74) *Attorney, Agent, or Firm*—Raymond Y. Chan; David and Raymond Patent Group

(57) ABSTRACT

An elongated rope light includes an elongated outer sheath having a first end, a second end, and an axial slot extended from the first end toward the second end, an intermediate sleeve, having an axial groove, fittedly received in the axial slot of the outer sheath wherein the intermediate sleeve has a first color section having a predetermined first color and a second color section having a predetermined second color different from the first color, and an illuminating unit including a plurality of illuminators spacedly disposed along the axial groove of the intermediate sleeve and an electric input electrically connected to the illuminators in such a manner that the illuminators are capable of respectively producing lights that transmit through the first and second colors sections of the intermediate sleeve so as to color up the lights with respect to the first and second colors.

20 Claims, 4 Drawing Sheets

ELONGATED ROPE LIGHT WITH MULTIPLE COLOR SECTIONS

BACKGROUND OF THE PRESENT INVENTION

1. Field of Invention

The present invention relates to a rope light arrangement, and more particularly to an elongated rope light with multiple color sections, which can not only enhance an aesthetical lighting effect but also extend the service life span of the rope light while being cost effective.

2. Description of Related Arts

A conventional rope light comprises a hollow outer cover and an illuminating unit coaxially received in the outer cover, wherein the illuminating unit comprises a hollow protective shelter and a plurality of illuminators spacedly received in the protective shelter in a water sealed manner and arranged to electrically connect with each other via a wire in a serial connection. Therefore, when the illuminators are electrically connected to an electric input, the illuminators illuminate lights and/or flash in sequence in order to provide an aesthetical lighting effect of the rope light.

Conventionally, there are two methods to spacedly mount the illuminators to the protective shelter. Firstly, the protective layer is constructed by two pieces of protective layers in such a manner that the illuminators are spacedly warped between the two protective layers in a water sealed manner. Secondly, a plurality of locating holes is spacedly provided along the protective shelter such that the illuminators are inserted into the locating holes respectively.

In order to enhance the aesthetic lighting effect of the rope light, colored illuminators can be used. However, due to the conventional technology, the rope light can only produce a mono color. For multi-color lighting effect, the rope light can be constructed to have a plurality of rope sections wherein each of the rope sections is coated by a desired color in such a manner that when the rope sections are electrically connected together end to end, the rope light is capable of producing multi-colors corresponding to the colors on the rope sections respectively. However, such rope light is unsafe since current leakage may occur at the electrical connection between the rope sections, so as to cause the short circuit of the rope light. Thus, the manufacturing cost of the rope light will be highly increased by complicating the manufacturing process for the rope sections with color coated thereon.

Another technology for the rope light to provide multi-color lighting effect is that the colors are coated on the protective shelter of the rope light. However, due to the physical structure of the protective shelter, the colors cannot evenly coated thereon. While spraying the colors the protective shelter, different densities of colors are coated thereon. For example, the seam connection between the two protective layers or the area around each locating hole will have higher density of the color. Therefore, when the illuminators are on, the rope light may have different brightness therealong, so as to provide a poor quality of the rope light.

Since the outer cover of the rope light has a smooth outer surface, the colors can evenly coated thereon to solve the above mentioned problem. However, the colors on the outer cover will be gradually fade out easily, especially when the rope light is used outdoors and discolored in strong sunlight. Furthermore, the color may contain poison materials such that the user, especially a child, will be directly infected while playing with the rope light. Therefore, most countries do not allow the manufacturer to import such unsafe rope light. However, it is not economized by using the color with non-poison material to achieve the multi-color lighting effect of the rope light.

SUMMARY OF THE PRESENT INVENTION

A main object of the present invention is to provide an elongated rope light with multiple color sections, wherein the rope light is safe to use for enhancing an aesthetical lighting effect of the rope light.

Another object of the present invention is to provide an elongated rope light with multiple color sections, which can extend the service life span of the rope light while being cost effective.

Another object of the present invention is to provide an elongated rope light with multiple color sections, wherein a color layer is protected by an outer cover of the rope light such that the color layer will not be faded out easily and directly infect to the user.

Another object of the present invention is to provide an elongated rope light with multiple color sections, which does not require to alter the original structural design of a convention rope light, so as to minimize the manufacturing cost of the present invention incorporated with the color layer.

Another object of the present invention is to provide an elongated rope light with multiple color sections, wherein no expensive or complicated structure is required to employ in the present invention in order to achieve the above mentioned objects. Therefore, the present invention successfully provides an economic and efficient solution for providing a safety configuration to achieve the multi-color lighting effect of the rope light.

Accordingly, in order to accomplish the above objects, the present invention provides an elongated rope light, comprising:

an elongated outer sheath, made of transparent material for transmitting light therethrough, having a first end, a second end, and an axial slot extended from the first end toward the second end;

an intermediate sleeve, having an axial groove, fittedly received in the axial slot of the outer sheath wherein the intermediate sleeve has a first color section having a first predetermined color and a second color section having a second predetermined color different from the first color; and an illuminating unit comprising a plurality of illuminators spacedly disposed along the axial groove of the intermediate sleeve and an electric input electrically connected to the illuminators and extended from the first end of the outer sheath to outside in such a manner that the illuminators are capable of respectively producing lights that transmit through the first and second colors sections of the intermediate sleeve so as to color up the lights with respect to the first and second colors.

DETAILED DESCRIPTION OF THE PREFERRED EMBODIMENT

Figure 1:
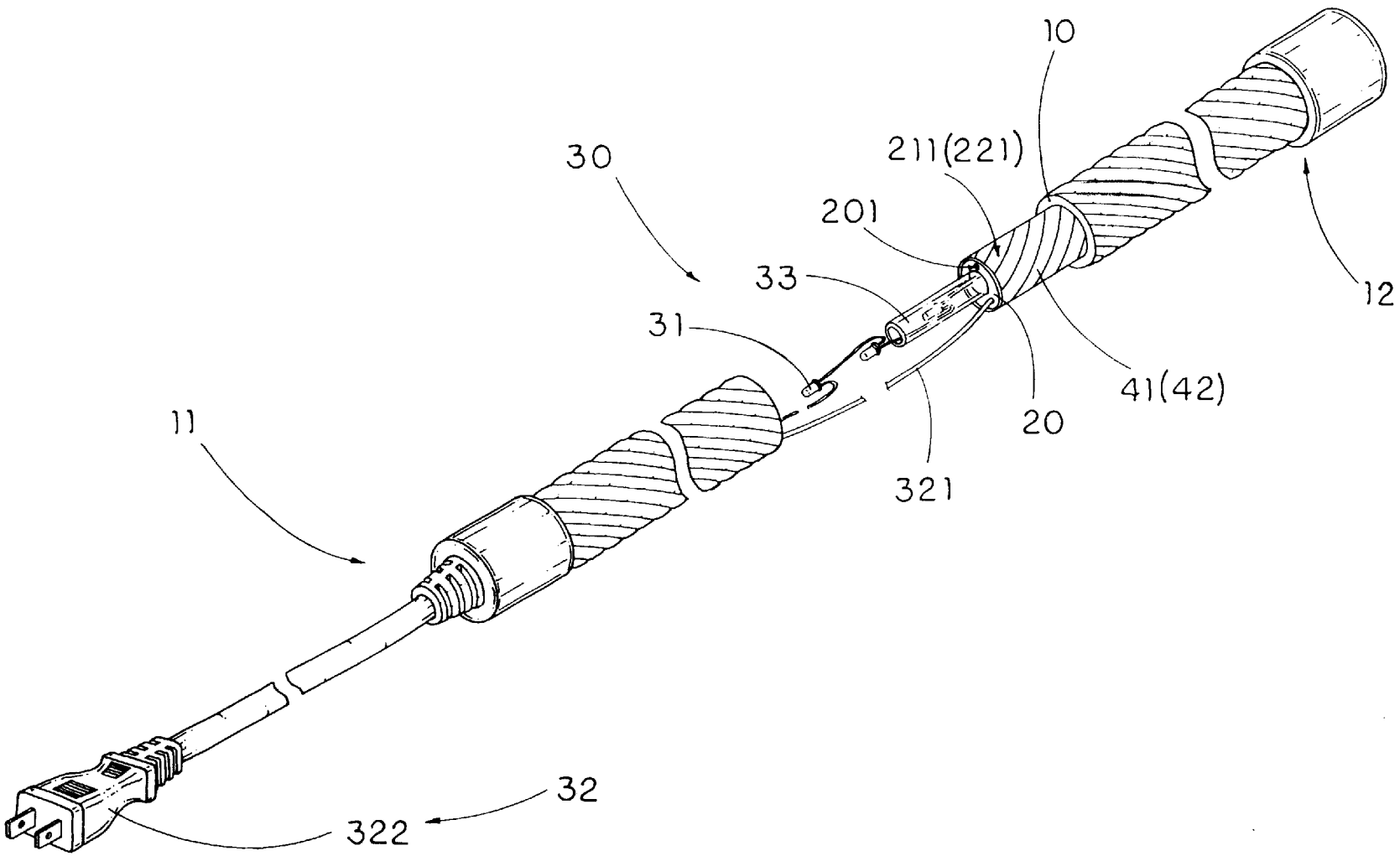
FIG. 1 is a perspective view of an elongated rope light with multiple color sections according to a preferred embodiment of the present invention.
Figure 2:
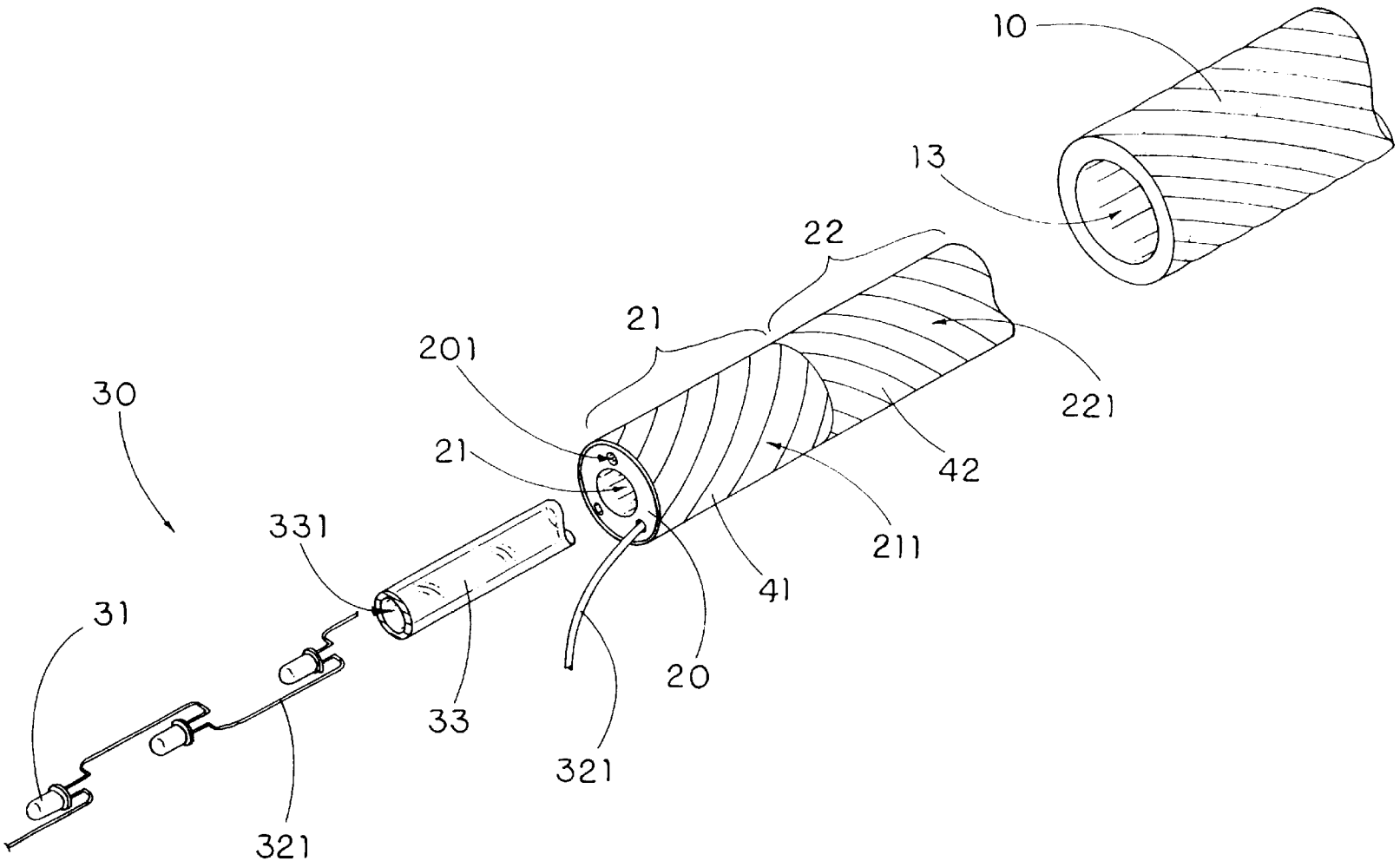
FIG. 2 is a partially exploded-perspective view of the elongated rope light with multiple color sections according to the above preferred embodiment of the present invention.
Figure 3:
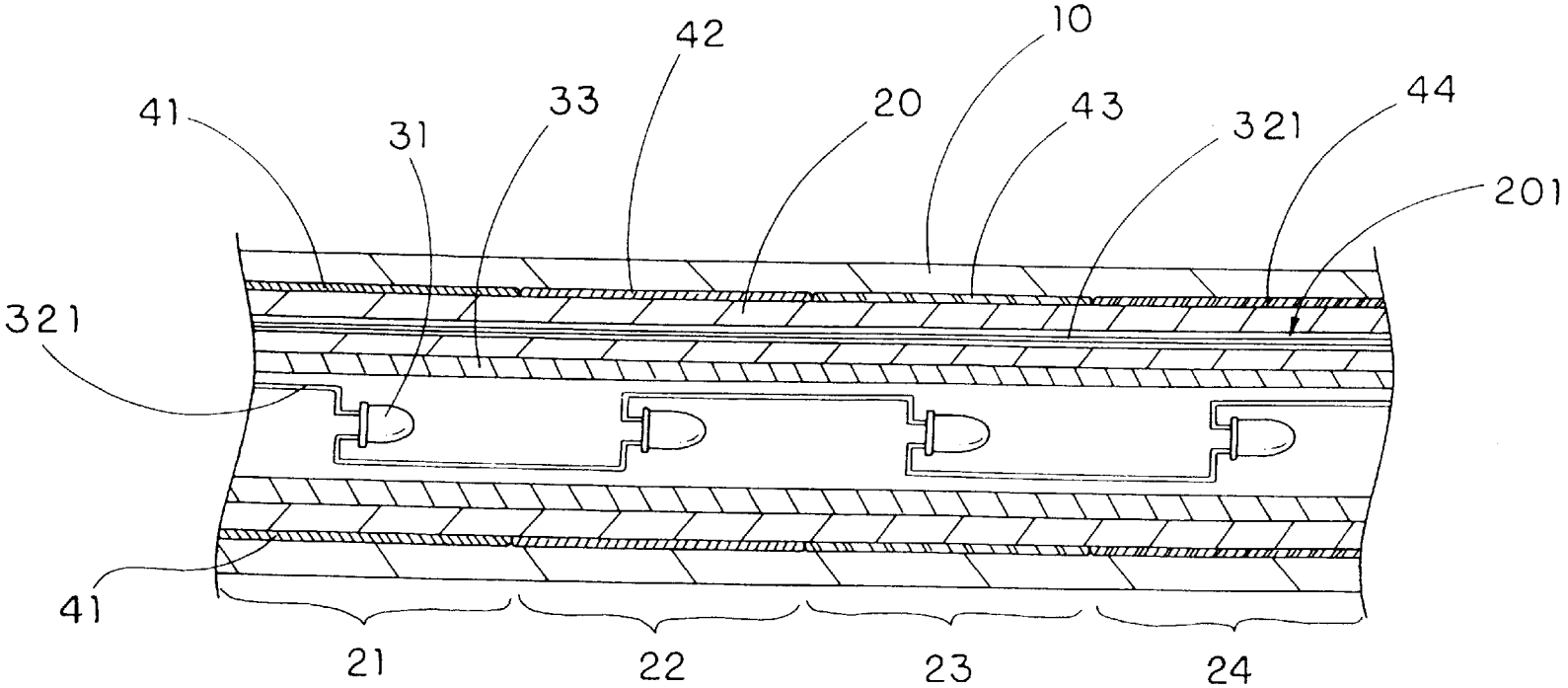
FIG. 3 is a partially sectional view of the elongated rope light with multiple color sections according to the above preferred embodiment of the present invention.

Referring to FIGS. 1 through 3 of the drawings, an elongated rope light with multiple color sections according to a preferred embodiment of the present invention is illustrated, wherein the rope light is capable of providing multiple color lighting effect.

The rope light comprises an elongated outer sheath 10 having a first end 11, a second end 12, and an axial slot 13 extended from the first end 11 toward the second end 12, and an intermediate sleeve 20, having an axial groove 21, fittedly received in the axial slot 13 of the outer sheath 10 wherein the intermediate sleeve 20 has a first color section 21 having a first predetermined color 211 and a second color section 22 having a second predetermined color 221 different from the first color 211.

The rope light further comprises an illuminating unit 30 comprising a plurality of illuminators 31 spacedly disposed along the axial groove 21 of the intermediate sleeve 20 and an electric input 32 electrically connected to the illuminators 31 and extended from the first end 11 of the outer sheath 10 to outside in such a manner the illuminators 31 are capable of producing lights respectively spreading out through the first and second colors sections 21, 22 of the intermediate sleeve 20 so as to color up the lights with respect to the first and second colors 211, 221.

According to the preferred embodiment, the outer sheath 10 is an extension tube made of transparent material, such as plastic such that the light from each of the illuminators 31 is adapted to transmit through the outer sheath 10 to outside. Thus, the outer sheath 10 should be made of insulating and durable material in order to protect the illuminators 31 inside the outer sheath 10 so as to prevent current leakage of the illuminators 31.

The intermediate sleeve 20 is also an extension tube coaxially fit into the outer sheath 10 such that the intermediate sleeve 20 is enclosed by the outer sheath 10 wherein the first and second color sections 21, 22 are transversely divided the intermediate sleeve 20 into two portions.

In order to form each of the first and second color sections 21, 22 of the intermediate sleeve 20, the rope light further comprises a first color film 41 having the first color 211 provided on an predetermined area of an outer surface of the intermediate sleeve 20 to form the first color section 21 thereof and a second color film 42 having the second color 221 provided on another predetermined area of the outer surface of the intermediate sleeve 20 to form the second color section 22 thereof. Preferably, each of the first and second color films 41, 42 is coated on the outer surface of the intermediate sleeve 20 respectively in such a manner that the first and second color films 41, 42 is protected by the 3outer sheath 10 so as to prevent the first and second films 41, 42 from being directly contacted from outside. In other words, the user cannot touch the first and second color films 41, 42 unless the outer sheath 10 is broken.

It is worth to mention that the first and second color films 41, 42 can be formed by directly spraying or dying the first color 211 and the second color 221 on the outer surface of the intermediate sleeve 20 respectively in such a manner that the first color 211 and the second color 221 is evenly distributed on the intermediate sleeve 20 having the smooth outer surface thereof.

As shown in FIG. 3, the rope light is embodied to have four color sections 21–24 having different colors such as red, green, blue, and yellow in such a manner that the lights produced by the illuminators 31 is capable of passing through and coloring up by the color sections 21–24 of the intermediate sleeve 20 having four color films 41–44 on the corresponding color sections 21–24, so as to provide a multi-color lighting effect of the rope light.

According to the preferred embodiment, the illuminating unit 30 further comprises a protective shelter 33, having an axial hole 331, coaxially received in the axial groove 21 of the intermediate sleeve 20 wherein the illuminators 31 are spacedly received in the axial hole 331 of the protective shelter 33 so as to hold the illuminators 31 in position.

The electric input 32 comprises an electric adapter 322 extended from the first end 11 of the outer sheath 10 to outside for electrically connecting with a power source P and at least a conducting wire 321 arranged to electrically connect the electric adapter 322 with the illuminators 31 in a serial connection and. As shown in FIG. 1, there are three conducting wires 321 selectively connected to the illuminators 31 respectively in such a manner that the illuminating unit 30 is capable of providing a flashing lighting effect for the rope light.

The conducting wire 321 has a connecting portion for electrically connecting the illuminators serially from the first end 11 of the outer sheath 10 to the second end 12 thereof through the axial hole 331 of the protective shelter 33 and a returning portion extending from the second end 12 of the outer sheath 10 back to the first end 11 thereof to electrically connect with the electric adapter 322 so as to form a closed circuit of the illuminating unit 30.

The intermediate sleeve 20 further has at least a guiding groove 201 longitudinal extended therefrom wherein the returning portion of the conducting wire 321 is extended from the second end 12 of the outer sheath 10 through the guiding groove 201 of the intermediate sleeve 20 to the electric adapter 322. In other words, the intermediate sleeve 20 not only colors up the lights from the illuminators 31 but also guides and protects the conducting wire 321 back to the electric adapter 322.

Accordingly, the rope light further comprises a rope stopper 50 provided at the second end 12 of the outer sheath 10 in water sealed manner for protecting the illuminators 31 so as to prevent water entering into the rope light.

Figure 4:
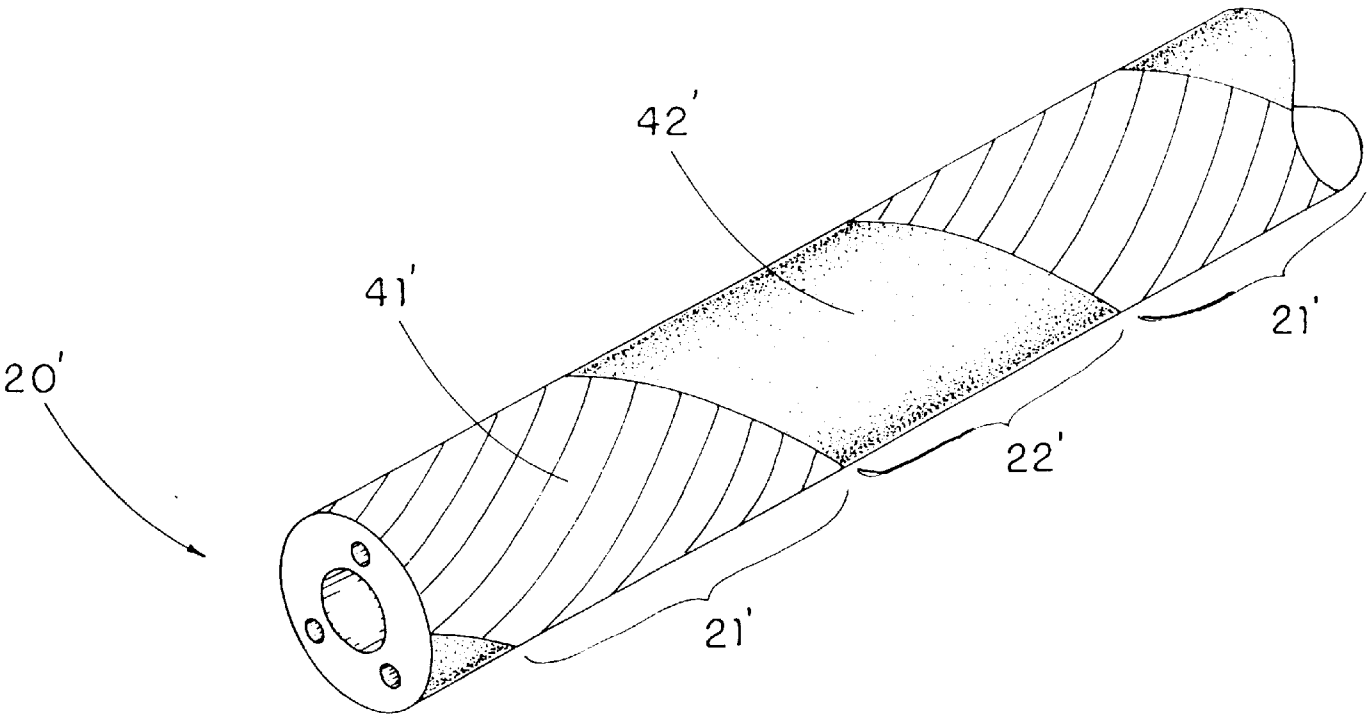
FIG. 4 illustrates an alternative mode of an intermediate sleeve of the elongated rope light with multiple color sections according to the above preferred embodiment of the present invention.

FIG. 4 illustrates an alternative mode of the intermediate sleeve 20' of the rope light according to the preferred embodiment of the present invention, wherein the first color film 41' and the second color film 41' are longitudinally attached along the intermediate sleeve 20' in a spiral manner to form the first and second color sections 21', 22' respectively. In other words, by selectively applying the color films on the outer surface of the intermediate sleeve 20' to form the color sections respectively, various color effects of the rope light can be obtained.

What is claimed is:

1. A rope light, comprising:

an elongated outer sheath, made of transparent material adapted for transmitting light therethrough, having a first end, a second end, and an axial slot extended from the first end toward the second end;

an intermediate sleeve, having an axial groove, fittedly received in said axial slot of said outer sheath wherein said intermediate sleeve has a first color section having a predetermined first color and a second color section having a predetermined second color different from said first color; and an illuminating unit comprising a plurality of illuminators spacedly disposed in along said axial groove of said-intermediate sleeve and an electric input electrically connected to said illuminators and extended from said first end of the outer sheath to outside in such a manner that said illuminators are capable of respectively producing lights that transmit through said first and second colors sections of said intermediate sleeve so as to color up said lights with respect to said first and second colors.

2. A rope light, as recited in claim 1, further comprising a first color film having said first color and a second color film having said second color provided on an outer surface of said intermediate sleeve to form said first color section and said second color section respectively in such a manner that said first and second color films are protected by said outer sheath.

3. A rope light, as recited in claim 2, wherein said outer surface of said intermediate sleeve is a smooth surface that said first and second color films are evenly coated on said outer surface of said intermediate sleeve for evenly coloring up said lights from said illuminators through said first and second color films respectively.

4. A rope light, as recited in claim 2, wherein said first color film and said second color film are attached on said outer surface of said intermediate sleeve respectively in a longitudinal direction, so as to transversely divide said intermediate sleeve in portions.

5. A rope light, as recited in claim 3, wherein said first color film and said second color film are attached on said outer surface of said intermediate sleeve respectively in a longitudinal direction, so as to transversely divide said intermediate sleeve in portions.

6. A rope light, as recited in claim 2, wherein said first color film and said second color film are longitudinally attached along said outer surface of said intermediate sleeve respectively in a spiral manner.

7. A rope light, as recited in claim 3, wherein said first color film and said second color film are longitudinally attached along said outer surface of said intermediate sleeve respectively in a spiral manner.

8. A rope light, as recited in claim 1, wherein said illuminating unit further comprises a protective shelter, having an axial hole, coaxially received in said axial groove of said intermediate sleeve wherein said illuminators are spacedly received in said axial hole of said protective shelter so as to hold said illuminators in position.

9. A rope light, as recited in claim 2, wherein said illuminating unit further comprises a protective shelter, having an axial hole, coaxially received in said axial groove of said intermediate sleeve wherein said illuminators are spacedly received in said axial hole of said protective shelter so as to hold said illuminators in position.

10. A rope light, as recited in claim 3, wherein said illuminating unit further comprises a protective shelter, having an axial hole, coaxially received in said axial groove of said intermediate sleeve wherein said illuminators are spacedly received in said axial hole of said protective shelter so as to hold said illuminators in position.

11. A rope light, as recited in claim 5, wherein said illuminating unit further comprises a protective shelter, having an axial hole, coaxially received in said axial groove of said intermediate sleeve wherein said illuminators are spacedly received in said axial hole of said protective shelter so as to hold said illuminators in position.

12. A rope light, as recited in claim 7, wherein said illuminating unit further comprises a protective shelter, having an axial hole, coaxially received in said axial groove of said intermediate sleeve wherein said illuminators are spacedly received in said axial hole of said protective shelter so as to hold said illuminators in position.

13. A rope light, as recited in claim 5, wherein said electric input comprises an electric adapter extended from said first end of said outer sheath to outside for electrically connecting with a power source and at least a conducting wire having a connecting portion extended from said first end of said outer sheath to said second end thereof for electrically connecting said illuminators and a returning portion extending from said second end of said outer sheath back to said electric adapter.

14. A rope light, as recited in claim 7, wherein said electric input comprises an electric adapter extended from said first end of said outer sheath to outside for electrically connecting with a power source and at least a conducting wire having a connecting portion extended from said first end of said outer sheath to said second end thereof for electrically connecting said illuminators and a returning portion extending from said second end of said outer sheath back to said electric adapter.

15. A rope light, as recited in claim 11, wherein said electric input comprises an electric adapter extended from said first end of said outer sheath to outside for electrically connecting with a power source and at least a conducting wire having a connecting portion extended from said first end of said outer sheath to said second end thereof for electrically connecting said illuminators and a returning portion extending from said second end of said outer sheath back to said electric adapter.

16. A rope light, as recited in claim 12, wherein said electric input comprises an electric adapter extended from said first end of said outer sheath to outside for electrically connecting with a power source and at least a conducting wire having a connecting portion extended from said first end of said outer sheath to said second end thereof for electrically connecting said illuminators and a returning portion extending from said second end of said outer sheath back to said electric adapter.

17. A rope light, as recited in claim 13, wherein said intermediate sleeve further has at least a guiding groove longitudinal extended therefrom wherein said returning portion of said conducting wire is extended from said second end of said outer sheath to said electric adapter through said guiding groove of said intermediate sleeve.

18. A rope light, as recited in claim 14, wherein said intermediate sleeve further has at least a guiding groove longitudinal extended therefrom wherein said returning portion of said conducting wire is extended from said second end of said outer sheath to said electric adapter through said guiding groove of said intermediate sleeve.

19. A rope light, as recited in claim 15, wherein said intermediate sleeve further has at least a guiding groove longitudinal extended therefrom wherein said returning portion of said conducting wire is extended from said second end of said outer sheath to said electric adapter through said guiding groove of said intermediate sleeve.

20. A rope light, as recited in claim 16, wherein said intermediate sleeve further has at least a guiding groove longitudinal extended therefrom wherein said returning portion of said conducting wire is extended from said second end of said outer sheath to said electric adapter through said guiding groove of said intermediate sleeve.

* * * * *